US006568489B1

(12) United States Patent
Hailey

(10) Patent No.: US 6,568,489 B1
(45) Date of Patent: May 27, 2003

(54) APPARATUS AND METHOD FOR DOWNHOLE LUBRICATION REPLENISHMENT

(76) Inventor: Charles D. Hailey, 11628 Burning Oaks, Oklahoma City, OK (US) 73150

( * ) Notice: Subject to any disclaimer, the term of this patent is extended or adjusted under 35 U.S.C. 154(b) by 58 days.

(21) Appl. No.: 09/836,741

(22) Filed: Apr. 17, 2001

(51) Int. Cl.[7] ..... E21B 10/24

(52) U.S. Cl. ..... 175/228; 175/107; 415/903; 415/110

(58) Field of Search ..... 175/228, 107; 415/903, 110

(56) References Cited

U.S. PATENT DOCUMENTS 1,406,931 A * 2/1922 Childs ..... 175/228
1,532,178 A * 4/1925 Godbold ..... 175/228
3,017,937 A * 1/1962 Bobo ..... 166/110
3,749,511 A * 7/1973 Mayal ..... 415/113
3,971,450 A * 7/1976 Fox ..... 175/107
4,114,704 A * 9/1978 Maurer et al. ..... 175/107
4,335,791 A * 6/1982 Evans ..... 175/228
4,372,400 A * 2/1983 Beimgraben ..... 175/107
4,548,283 A * 10/1985 Young ..... 175/107
4,613,002 A * 9/1986 Pittman et al. ..... 175/107
4,646,856 A * 3/1987 Dismukes ..... 175/107
5,377,771 A * 1/1995 Wenzel ..... 175/107

* cited by examiner

*Primary Examiner*—David Bagnell
*Assistant Examiner*—Thomas Bomar
(74) *Attorney, Agent, or Firm*—McAfee & Taft

(57) ABSTRACT

A lubricant ejector used downhole has a reservoir holding replenishment lubricant, and it includes a driver to eject at least a portion of the lubricant. A flow coupler connected to the ejector channels lubricant to a connected apparatus. One specific ejector includes a hollow rotor of a downhole motor, and a specific flow coupler includes a cross-channel diverter that directs lubricant from the hollow interior of the rotor to a bearing pack and that directs drilling fluid, used to drive the motor and create pressure that moves a piston in the rotor, from outside the rotor to inside a passageway through the bearing pack. A method includes injecting lubricant from a reservoir in the downhole motor into the bearing pack as the downhole motor operates.

14 Claims, 4 Drawing Sheets

24
22
10
18
20
16
8
20
6
2
12
36
34
104
98
14
102
30
96
54
100
28
60
52
4
45
44
56
50
32
40
45
48
58
42
46

APPARATUS AND METHOD FOR DOWNHOLE LUBRICATION REPLENISHMENT

BACKGROUND OF THE INVENTION

This invention relates generally to systems, components, and methods for providing lubrication in a subterranean environment, such as in a well or in underground utility work. A particular aspect of the invention relates to an extended-lubrication downhole motor.

Various subterranean operations require there to he movement between parts that need to be lubricated for one or more reasons (for example, to facilitate movement, to reduce frictional heating). The lubricant in these uses tends to degrade or be used up as the operation in which the lubrication is needed continues. On-going replenishment of the lubricant would be desirable to prolong the operating time. Although this need may exist in various subterranean uses, one particular use is in downhole motors that may be used in underground utility work or in drilling wells, for example. The following explanation refers to such use in an oil or gas well; however, the present invention is not limited in its broader aspects to this particular use or environment.

One kind of movement that may occur between parts in a tubing string that has been lowered into a well is rotary motion. One example of such rotary motion is that which occurs during drilling a well using coiled tubing and a downhole motor attached in the coiled tubing string. A housing connected to the coiled tubing acts as a stator of the downhole motor, inside of which is a rotor to which the drill bit is connected. A bearing pack is connected between the rotor and the connected working implement (the drill bit in this example). The bearing pack is filled with a lubricant to reduce friction and heating as the rotor rotates inside the stator in response to drilling fluid being pumped through the coiled tubing and the downhole motor.

A conventional coiled tubing downhole motor as just described may operate until the lubricant is sufficiently used up (for example, by thinning and migrating around the seals and out of the sealed region). So, one limitation on how long a downhole motor of this type can be used in the well is how long sufficient lubricant can be retained in the bearing pack before the tubing string needs to be withdrawn from the well and the bearing pack repaired or replaced. Pulling the coiled tubing string out of the well, repairing or replacing the bearing pack, and again running the tubing string back into the well are time consuming and costly. To reduce such time and cost, there is the need for an improved downhole lubrication system and method and components for such system and method whereby longer downhole working times can be obtained so that, for the above example, fewer, less frequent trips out of the well are needed. There is a particular need for an extended-lubrication downhole motor. Although I am aware of a type of drill bit that moves lubricant from one or more supplies in the bit in response to the rotational force as the bit is rotated, my invention is distinguishable in satisfying the aforementioned needs.

SUMMARY OF THE INVENTION

The present invention overcomes the above-noted and other shortcomings of the prior art, and meets the aforementioned needs, by providing for novel and improved lubrication replenishment downhole in a subterranean environment by way of the novel and improved system, components, and method of the present invention. In addition to the advantage of providing lubrication replenishment in a subterranean environment, the present invention has the advantage of providing such lubrication automatically (that is, without control from the surface apart from providing basic operation of the tool, such as a pressurized flow of fluid into a downhole motor). Such automatic lubrication replenishment is provided in a relatively simple, relatively low maintenance manner such that extended tool operating times can be obtained. Still another advantage is that such replenishment can be incorporated to provide a novel and improved extended-lubrication downhole motor, and preferably one which can operate downhole longer than previous conventional types of downhole motors. The invention can be used in various fields, including without limitation the oil and gas industry and the various utility (for example, electrical power, gas, communications) industries.

The present invention provides a downhole lubrication system comprising a lubricant ejector having a reservoir defined in it to hold replenishment lubricant. The lubricant injector includes a driver to move at least a portion of the replenishment lubricant out of the reservoir in response to a pressure from a flowing fluid. The lubricant ejector is defined to be moved downhole with apparatus requiring lubrication and having a lubrication chamber. Also included in the downhole lubrication system is a flow coupler connected to the lubricant ejector such that the flow coupler channels to the tool's lubrication chamber replenishment lubricant moved out of the reservoir in response to operation of the driver.

In a particular implementation, the downhole lubrication system includes a downhole lubricant applicator comprising lubricant and a rotor for a downhole motor, wherein the rotor has a longitudinal bore holding the lubricant. The longitudinal bore has a first end through which to receive a force to move at least a portion of the lubricant out a second end of the longitudinal bore. This downhole lubricant applicator may further comprise a flow coupler connected to the rotor. The flow coupler has a channel defined with a port communicating with the second end of the longitudinal bore. The channel also has another port, this one communicating with an outer lubrication chamber of a bearing pack of the downhole motor.

A particular component for the flow coupler includes a flow diverter comprising an inner body having an upper end for connecting to the rotor of a downhole motor and having a lower end for connecting to a bearing pack of the downhole motor. Defined in the inner body are an upper cavity extending into the inner body from the upper end, a lower cavity extending into the inner body from the lower end, an upper aperture communicating with the lower cavity, and a lower aperture communicating with the upper cavity. The inner body further includes a seal bearing surface disposed between the upper and lower apertures. The flow diverter may further comprise a housing having the inner body disposed therein and a seal disposed between the seal bearing surface and an inner surface of the housing. In a particular implementation, the upper aperture and the lower cavity are configured to conduct a flow of drilling fluid pumped through a tubing string, and the upper cavity and the lower aperture are configured to conduct a flow of replenishment lubricant from the rotor to the bearing pack, when the flow diverter is connected into the tubing string with the downhole motor.

Another component for the flow coupler is a flex coupling having a passageway that communicates between the rotor and the flow diverter.

The present invention also provides a downhole motor, comprising: a stator; a rotor disposed in the stator; replenishment lubricant disposed in a reservoir defined within the downhole motor; and a bearing pack connected to the stator, the rotor and the reservoir of replenishment lubricant such that replenishment lubricant moves into the bearing pack from the reservoir as the downhole motor operates.

The present invention more particularly provides an extended-lubrication downhole motor. This downhole motor comprises a stator configured to connect in a tubing string. It also comprises a rotor disposed in the stator such that the rotor rotates in response to fluid pumped through the stator from the tubing string, the rotor having an axial bore. The downhole motor further comprises lubricant disposed in the axial bore and a piston disposed in the axial bore above the lubricant. A plug having an orifice defined in it is connected to the rotor such that pressure from the pumped fluid communicates through the orifice and acts against the piston. A bearing pack of the downhole motor is connected to a flow coupler of the downhole motor, which flow coupler is also connected to the rotor. The connection of the flow coupler to the rotor and the bearing pack is such that the flow coupler communicates to the bearing pack lubricant pushed out of the rotor in response to movement of the piston toward the lubricant in the rotor in response to pressure from the pumped fluid communicated through the orifice. In a particular implementation, the bearing pack has a longitudinal flow passageway to conduct motive fluid that has flowed along the exterior of the rotor, and the bearing back has a lubricant chamber disposed radially outwardly from the longitudinal flow passageway. In such implementation the flow coupler includes a flow diverter having a body connected to the rotor and the bearing pack. This flow coupler also has a seal disposed on the body. The body has a first channel communicating with the axial bore of the rotor above the seal and with the lubricant chamber of the bearing pack below the seal. The body has a second channel communicating with the exterior of the body above the seal and with the longitudinal flow passageway of the bearing pack below the seal. The flow coupler may further include a flex shaft connected to the rotor and the body of the flow diverter, with the flex shaft having a passage defined through it to provide a lubricant flow path between the axial bore of the rotor and the first channel in the body.

The present invention also provides a method of replenishing lubricant in a downhole motor. This method comprises injecting replenishment lubricant from a reservoir of replenishment lubricant in the downhole motor into a bearing pack of the downhole motor as the downhole motor operates.

The present invention also provides a method of replenishing lubricant in a downhole motor. This definition of the present invention comprises: operating a downhole motor disposed in a subterranean environment, including pumping fluid into the downhole motor; moving lubricant from a reservoir in a rotor of the downhole motor, including communicating a pressure responsive to the pumped fluid against a piston disposed in the reservoir with the lubricant; and cross-channeling moved lubricant and pumped fluid within the downhole motor, including conducting moved lubricant from the reservoir to a bearing pack of the downhole motor and conducting pumped fluid from outside the rotor to a passageway through the bearing pack.

Therefore, from the foregoing, it is a general object of the present invention to provide for novel and improved lubrication replenishment downhole in a subterranean environment by way of the novel and improved system, components, and method of the present invention, one particular embodiment of which includes an extended-lubrication downhole motor. Other and further objects, features and advantages of the present invention will be readily apparent to those skilled in the art when the following description of the preferred embodiments is read in conjunction with the accompanying drawings.

DESCRIPTION OF THE DRAWINGS

FIG. 6 is a sectioned elevational view of the preferred embodiment of a flow diverter of the present invention.

DETAILED DESCRIPTION OF THE INVENTION

Figure 1:
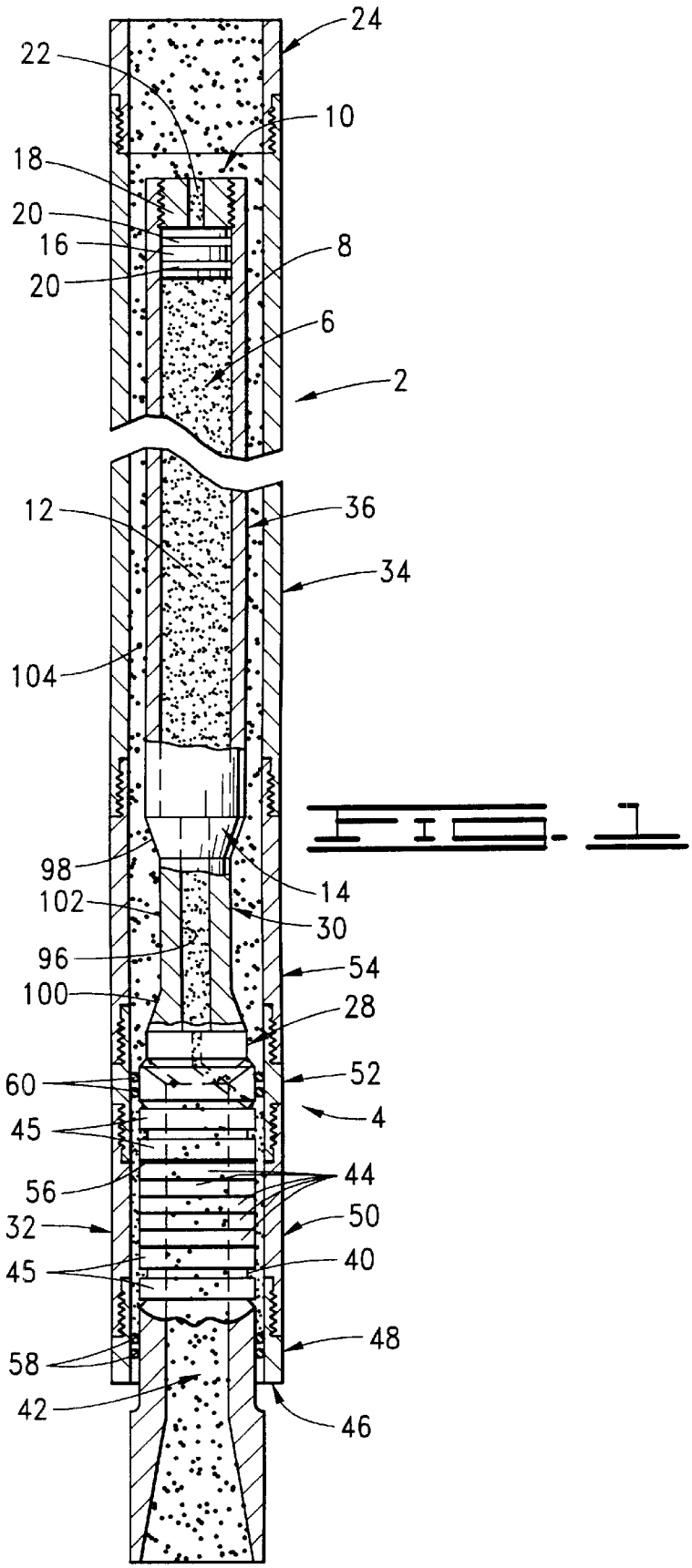
FIG. 1 is a schematic elevational view of part of a coiled tubing string including a downhole lubrication system of the present invention.
Figure 2:
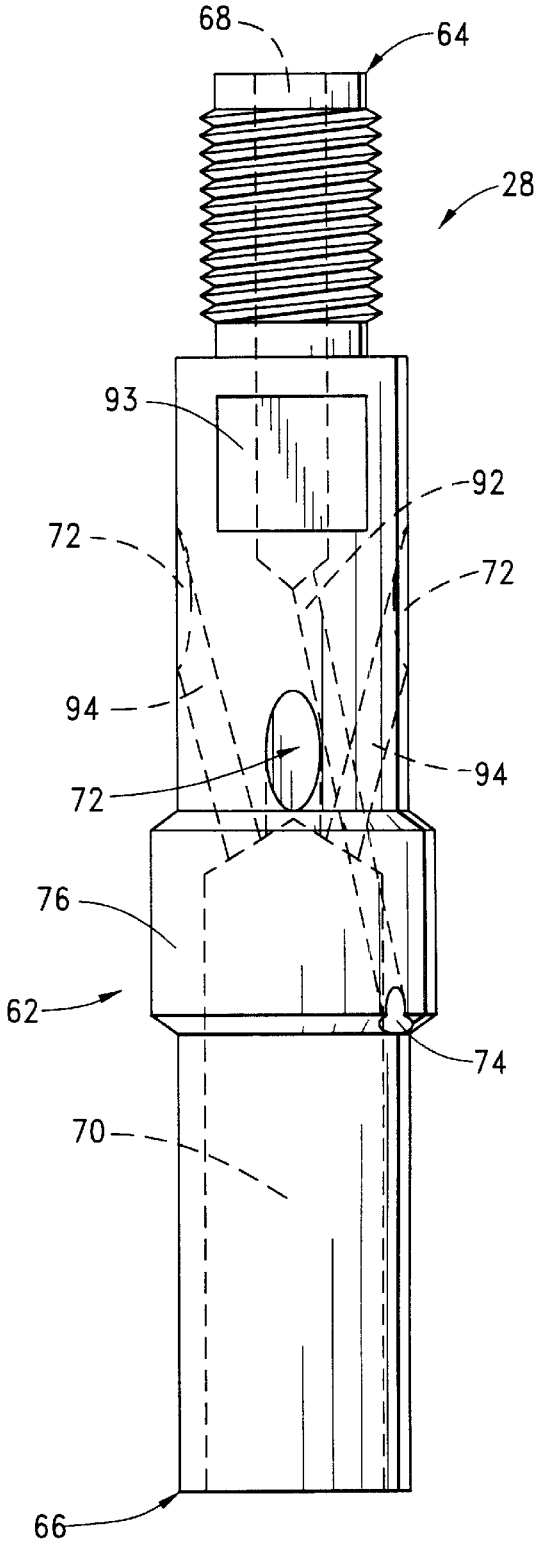
FIG. 2 is an elevational view of a preferred embodiment of a flow diverter of the present invention.
Figure 3:
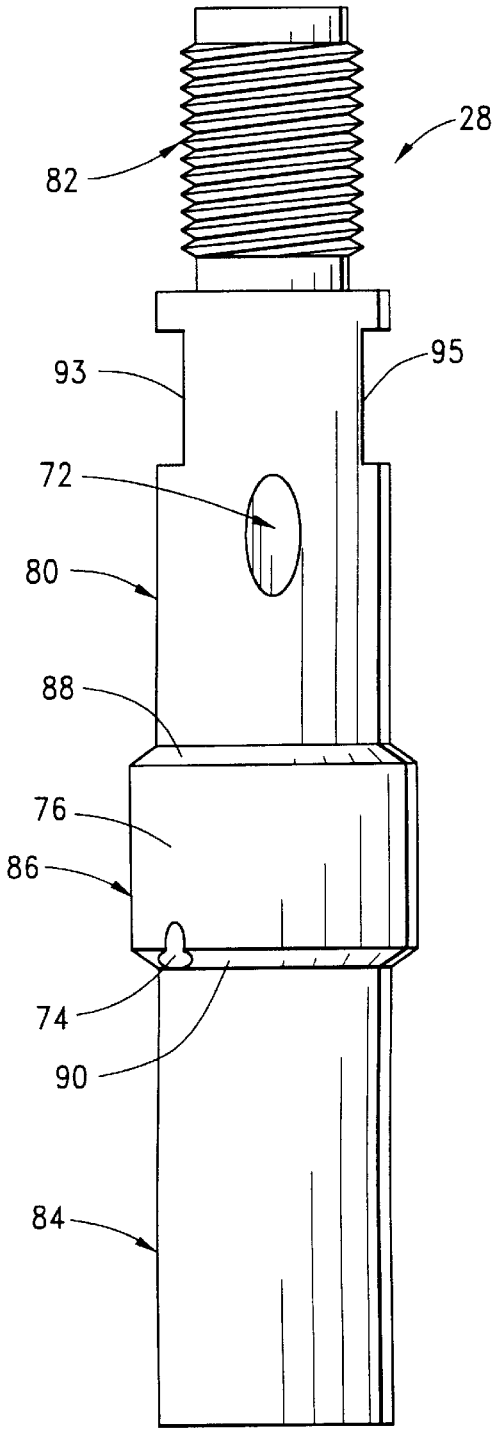
FIG. 3 is another elevational view, rotated 90° from the view of FIG. 2, of the preferred embodiment of a flow diverter of the present invention.
Figure 4:
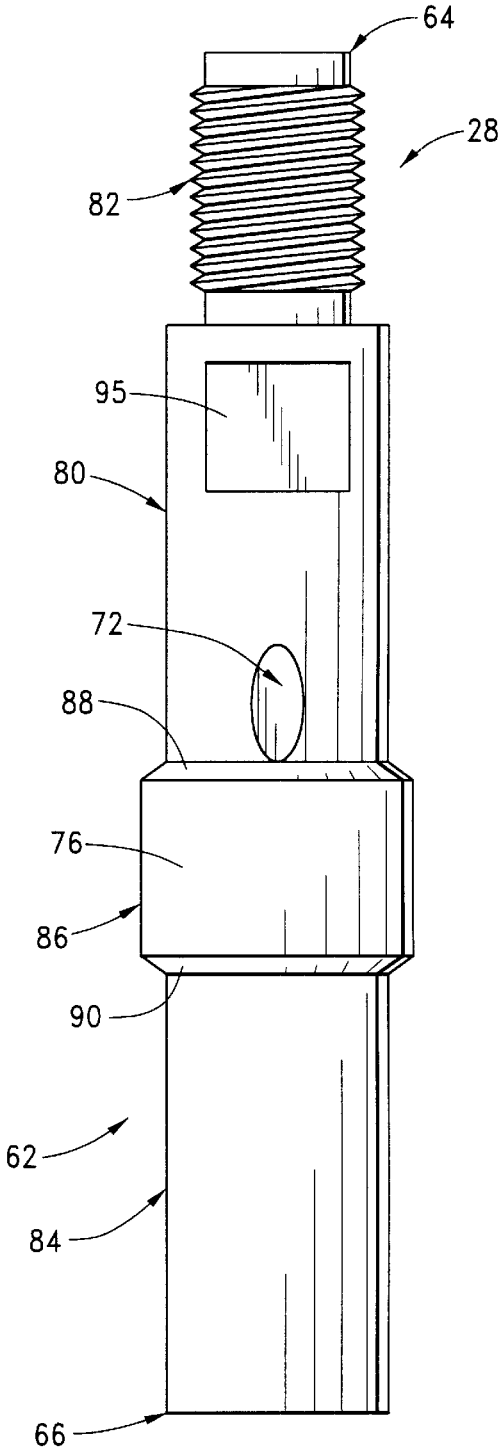
FIG. 4 is a further elevational view, rotated a further 90° from the view of FIG. 3, of the preferred embodiment of a flow diverter of the present invention.
Figure 5:
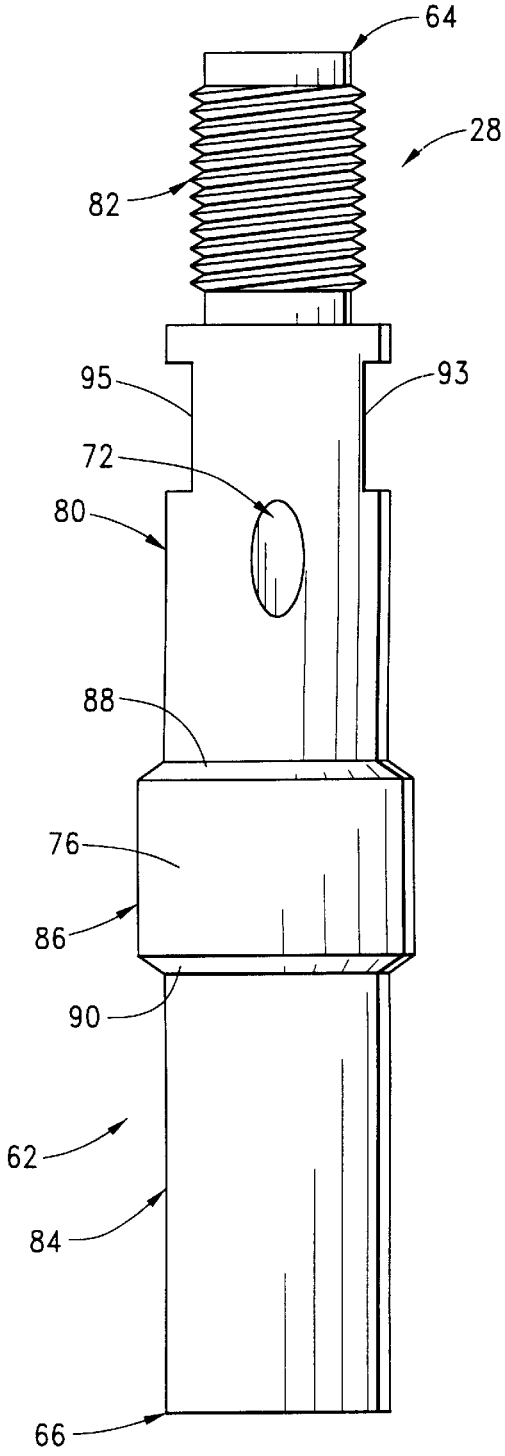
FIG. 5 is still another elevational view, rotated a further 90° from the view of FIG. 4, of the preferred embodiment of a flow diverter of the present invention.
Figure 5:
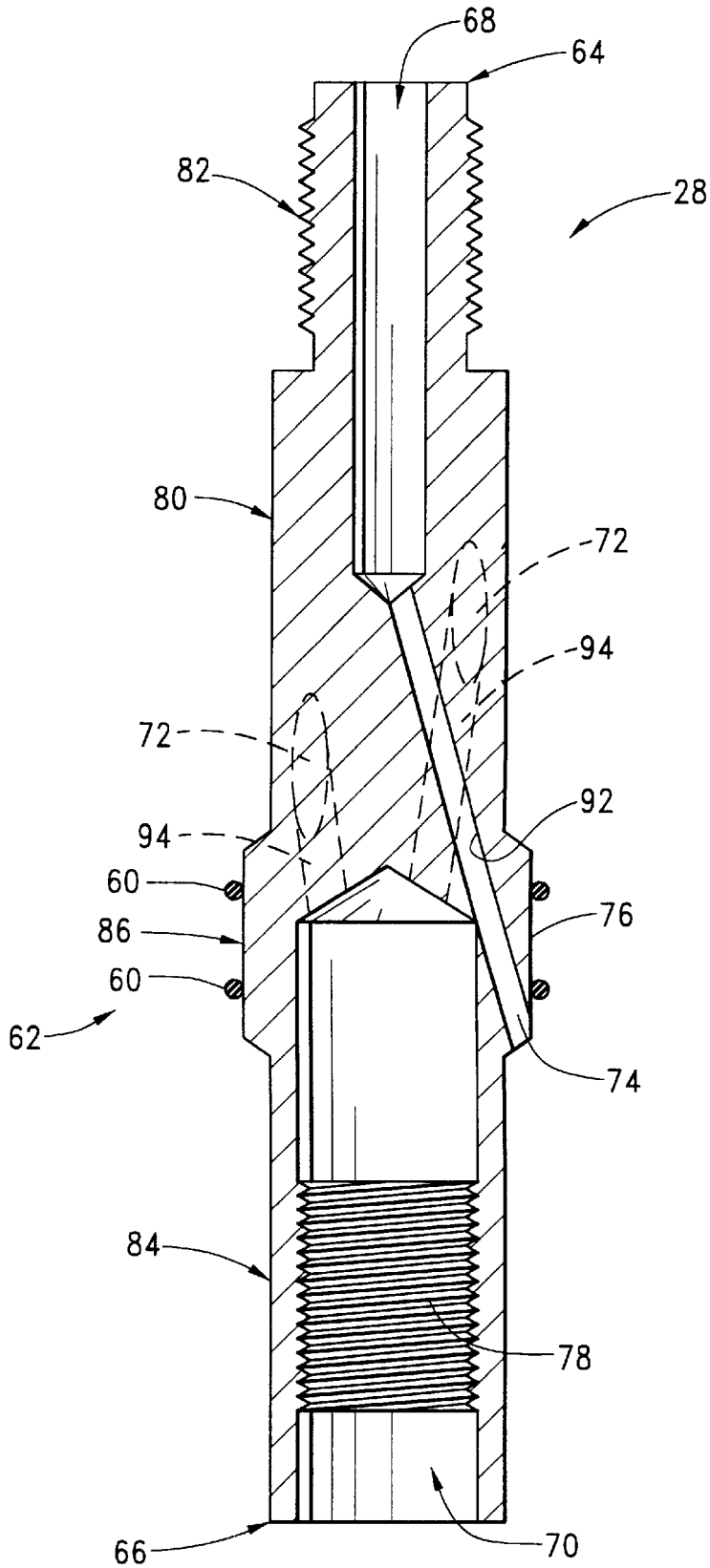

The system and components of the present invention will be described in general with reference to FIG. 1, and then the invention will be more specifically described for the particular implementation shown in FIG. 1 as an extended-lubrication downhole motor for coiled tubing. A preferred embodiment of a flow diverter of the present invention will be described with reference to FIGS. 2–6. As mentioned above, these particular implementations and preferred embodiments do not limit broader aspects of the present invention.

The present invention provides a downhole lubrication system or applicator that can be used to provide lubricant to a downhole apparatus having a lubricant chamber (that is, something requiring lubricant somewhere in it). This system or applicator comprises a lubricant ejector 2 and a flow coupler 4. The lubricant ejector 2 has a reservoir defined in it to hold or store lubricant that can be provided to the requisite apparatus. In the FIG. 1 implementation, the reservoir is defined as a cavity 6 formed in a tubular member 8; however, the reservoir can be defined in other suitable downhole structure. In FIG. 1, the cavity 6 has a first end 10 through which a driving force is applied against lubricant 12 in the cavity to move lubricant out a second end 14 of the cavity 6.

The lubricant ejector 2 of FIG. 1 also includes a piston 16 disposed in the reservoir and a plug 18 connected to the tubular member 8. The piston 16 of the illustrated embodiment shown in FIG. 1 is a cylindrical body which carries one or more external sealing members 20 (two are shown in FIG. 1). The plug 18 is also a cylindrical member; however, it is externally threaded to screw into complementally threaded end 10 of the tubular member 8. The plug 18 also has a longitudinal (specifically axial) port 22 defining an orifice through the body of the plug 18. This orifice is suitably sized such that it communicates sufficient pressure to act on the piston 16 to implement a driver which moves at least a portion of the replenishment lubricant out of the reservoir of the tubular member 8 through the second end 14 and into the flow coupler 4; however, the orifice 22 should also be sized to prevent too much pressure acting against the piston 16 so that over-pressure damage does not occur in the lubricant system (for example, so that seals holding lubricant are not blown out or otherwise breached).

The flow coupler 4 is connected to the lubricant ejector 2 such that the flow coupler 4 channels to the lubrication chamber in the apparatus requiring lubrication replenishment lubricant moved out of the reservoir in response to operation of the driver. In FIG. 1, the flow coupler 4 has a channel defined in it for communicating lubricant from the second end 14 of the cavity 6 of the tubular member 8 to the apparatus (and so the flow coupler 4 can also be a reservoir of lubricant). In the illustrated preferred embodiment, the flow coupler 4 and the lubricant ejector 2 are moved into a well on coiled tubing of suitable type known in the art (not shown, but connected in known manner to a top sub 24 of the downhole motor particularly illustrated in FIG. 1). Typically, the coiled tubing and downhole lubrication system of the present invention carry a working implement or tool into the well; non-limiting examples include a drill bit, a mill or other rotary cutting elements.

The flow coupler 4 of the preferred embodiment includes a flow diverter 28 and preferably also a flex coupling 30. The flow diverter 28 is itself an inventive component of the present invention. In the illustrated embodiment of FIG. 1, it is connected to the flex coupling 30 and is configured to connect to a bearing pack 32 defining in the illustration of FIG. 1 one particular apparatus which requires lubrication.

Still referring to FIG. 1, a more detailed explanation of the specific apparatus shown therein will be given. This implementation is of an extended-lubrication downhole motor. Without limiting broader aspects of the invention, one particular type of downhole motor is a positive displacement motor, and specifically one for coiled tubing. The motor includes a stator 34 which is implemented in FIG. 1 in conventional manner by a cylindrical tube threadedly connected to the top sub 24 that is connected in known manner to the coiled tubing. The stator 34 of a particular implementation has a rubber lining defining a plurality of spiral grooves as known in the art (not shown).

The downhole motor also includes a rotor 36, which is disposed in the stator 34 such that the rotor 36 rotates in response to fluid pumped in known manner through the stator 34 from the coiled tubing. The illustrated rotor 36 is of a known type that includes the tubular member 8 and has a longitudinal (specifically axial) bore defining the cavity 6; however, the rotor is configured to receive the lubricant 12 and the piston 16 and it is threaded on its inside surface at end 10 to receive the plug 18. The rotor 36 of this implementation is particularly a cylindrical tube having helical grooves (not shown, but as known in the art) formed in the outside surface such that as pumped fluid flows along this external surface of the rotor 36 and the adjacent grooves on the inner surface of the stator 34 referred to above, the force of the fluid engaging the helical grooves rotates the rotor 36 relative to the stator 34. As known in the art, the grooves of the rotor 36 and those of the stator 34 are preferably of different pitch to increase the torque applied to the rotor 36.

The downhole motor represented in FIG. 1 also includes the lubricant 12 disposed in the axial bore of the rotor 36. The lubricant is of any type suitable for its intended use; a non-limiting example includes a high quality, high temperature (for example, 500° F.) grease.

The downhole motor of the present invention also includes the piston 16 and the plug 18. The piston 16 is disposed in the axial bore of the rotor 36 above the lubricant 12. The plug 18 has the orifice 22 defined in it, and the plug 18 is threadedly connected to the inwardly threaded end 10 of the rotor 36 such that pressure from the pumped fluid communicates through the orifice 22 and acts against the piston 16.

The downhole motor also includes the bearing pack 32 and the flow coupler 4 having in the illustrated embodiment the flow diverter 28 and the flex coupling 30. In general, the flow coupler 4 is connected to the rotor 36 and the bearing pack 32 such that the flow coupler 4 communicates to the bearing pack 32 lubricant pushed out of the rotor 36 in response to movement of the piston 16 toward the lubricant 12 in the rotor 36 in response to pressure from the pumped fluid communicated through the orifice 22 in the plug 18. It is contemplated that movement of lubricant out a reservoir can be effected by other forces, such as by gravity feed or by centrifugal force, for example.

The bearing pack 32 is of a conventional type known in the art. For example, it includes a mandrel 40 which has a longitudinal flow passageway 42 to conduct motive fluid that has flowed along the exterior of the rotor 36 (for example, drilling fluid pumped down the coiled tubing in known manner to both energize the downhole motor and lubricate and flush cuttings created by the cutting tool being rotated). Mounted on the mandrel 40 are thrust bearings 44 and roller thrust bearings 45 (also in part on the diverter 28) which facilitate rotation with bearing housing 46 having threadedly connected bottom sub 48, medial member 50 and twin-pin sub 52, which connects to a housing 54 for the flex coupling 30. The housing 54 threadedly connects to the stator 34. These threaded connections use left-handed threads in the illustrated implementation. When assembled as illustrated in FIG. 1, the bearings 44, 45 are within a lubricant chamber 56 defined at least in part between the mandrel 40 and the cylindrical medial member 50. The chamber 56 is radially outward from the passageway 42 through the mandrel 40. The lower end of the chamber 56 is defined by seals 58 on the mandrel 40 engaging the inner surface of bottom sub 48. The upper end of this chamber 56 is defined by seals 60 on the flow diverter 28 which is housed within twin-pin sub 52. Seals 58, 60 of a particular implementation are quad rings with backup rings.

Referring to FIGS. 2–6, the flow diverter 28 comprises an inner body 62 having an upper end 64 for connecting to the rotor 36 (via the flex coupling 30 in this embodiment) and having a lower end 66 for connecting to the bearing pack 32. Referring to FIG. 6, the inner body 62 has defined therein: an upper longitudinal cavity 68 extending into the inner body from the upper end; a lower longitudinal cavity 70 extending into the inner body from the lower end; one or more upper apertures 72 (four in the illustrated embodiment; see FIGS. 2–5) communicating with the lower cavity 70; and at least one lower aperture 74 (see also FIGS. 2 and 3 in which one aperture 74 is shown; although more than one can be used, cumulative flow of lubricant through them should be small enough to avoid damaging the lubricant system (for example, to avoid blowing out seals 58, 60)) communicating with the upper cavity 68. The inner body further includes a seal bearing surface 76 disposed between the upper and lower apertures. The inner body 62 is disposed within the outer housing defined in the FIG. 1 embodiment by the twin-pin sub 52. One or more seals 60 (two are illustrated) are disposed between the seal bearing surface 76 and an inner surface of the housing provided by the sub 52 as shown in FIG. 1. The upper cavity 68 and the lower aperture 74 are configured to conduct a flow of replenishment lubricant from the rotor 36 to the bearing pack 32; that is, the inner body 62 has a first channel communicating with the axial bore of the rotor 36 above the seal(s) 60 and with the lubricant chamber 56 of the bearing pack 32 below the seal(s) 60. The upper aperture(s) 72 and the lower cavity 70 are configured to conduct a flow of drilling fluid pumped through the tubing string; that is, the inner body 62 has a second channel (or several of them when there are multiple apertures 72 as in the illustrated embodiment) communicating with the exterior of the inner body above the seal(s) 60 and with the longitudinal flow passageway 42 of the bearing pack 32 below the seal(s) 60.

The flow diverter 28 of the illustrated embodiment specifically includes a body formed (such as by suitable machining techniques) to include an upper cylindrical portion 80 from which a threaded coupling 82 extends at the upper end 64 to mate with the lower end of the flex coupling 30. The upper cylindrical portion includes the upper cavity 68 such that the upper cavity receives from the rotor 36 lubricant for the downhole bearing pack 32 when used.

The formed body also includes a lower cylindrical portion 84 having a partially threaded inner surface 78 (FIG. 6) which connects to a threaded pin end of the downhole bearing pack 32 when used downhole. The lower cavity 70 is formed in this cylindrical portion in part by the threaded surface 78, below which is a surface against which a seal on the bearing pack 32 acts.

The formed body 62 still further includes a middle cylindrical portion 86 extending between the upper and lower cylindrical portions and defining the seal bearing surface 76. The middle cylindrical portion includes this outer cylindrical surface disposed radially outwardly from the outer cylindrical surfaces of the upper and lower cylindrical portions as apparent in FIGS. 2–6. Tapered shoulders 88, 90 extend between these surfaces.

In the illustrated embodiment, the first channel of the flow diverter 28 includes a machined bore 92 (FIGS. 2 and 6) that extends at an angle between the upper cavity 68 and the aperture 74 at the exterior of the middle cylindrical portion 86, thereby defining a port deviated from the cavity. Each second channel includes a respective machined bore 94 (FIGS. 2 and 6) that extends at an angle between its respective aperture 72 at the outer cylindrical surface of the upper cylindrical portion 80 and the lower cavity 70 such that such second channel conducts drilling (or other motive) fluid from within the downhole motor into the lower cavity 70 for flow on through the bearing pack 32 when used downhole. The. deviations or angles of the bores 92, 94 are sufficient to join the respective cavities and apertures depending on the size of the body 62 and its respective portions.

Flat surfaces 93, 95 are defined in upper portion 80 to receive a wrench with which to tighten, loosen or hold the diverter 28 of this implementation.

Returning to FIG. 1, threadedly connected to the coupling 82 at the upper end 64 of the diverter 28 is the flex coupling 30, also referred to as a flex shaft, which is a known device for downhole motors. At its other end, the flex coupling 30 is threadedly connected to the rotor 36 in known manner. The flex coupling 30 has a passage 96 defined longitudinally (specifically axially) throughout. This provides an open flow path for the lubricant between the second end 14 of the cavity 6 in the rotor 36 and the flow diverter 28. The flex coupling 30 has upper and lower ends 98, 100 which taper to a narrower central shaft portion 102, through all of which the passage 96 is defined. The shape and construction of the flex coupling 30 are preferably such that the central shaft twists if an over-torque condition results, whereby the flex coupling 30 provides a safety point of failure to avoid damage to other components of the downhole structure illustrated in FIG. 1 should a significant over-torqued condition occur.

The piston 16, the plug 18, and the diverter 28 are made of suitable material for the intended use as known in the art. For use in an oil or gas well, suitable metal is preferably used and stainless steel is one specific material. Seals are used as described above or as otherwise needed to create fluid-tight connections, for example, and such seals are made of suitable material as known in the art. Other components can be of conventional, known type. Conventional machining techniques can be used to form the respective metallic members.

In the operation of the present invention, which specifically provides a method of replenishing lubricant in a downhole motor, the method comprises injecting replenishment lubricant from a reservoir of replenishment lubricant in the downhole motor into a bearing pack of the downhole motor as the downhole motor operates. Referring to FIG. 1, lubricant from the reservoir 6 in the rotor 36 is ejected from the rotor and injected into the bearing pack 32 of the downhole motor. A particular implementation of this method comprises operating a downhole motor disposed in a subterranean environment, including pumping fluid into the downhole motor. Referring to FIG. 1, fluid 104 (for example, drilling fluid or other suitable fluid) is pumped from the surface in known manner, through the coiled tubing and the top sub 24, into the space between the stator 34 and the rotor 36 as represented in the drawing. The force of this flow moving through the grooves on the stator and rotor rotates the rotor 36, and this pumped fluid also creates pressure that is communicated through the orifice 22 in the plug 18.

The method further comprises moving lubricant from the reservoir. In general, this can be by any suitable force (for example, gravity feed, centrifugal force); however, as mentioned with regard to the FIG. 1 implementation, pressure responsive to the pumped fluid is communicated through the orifice 22, and this pressure acts against the piston 16 disposed in the reservoir with the lubricant 12. This automatically pushes lubricant out of the lower end of the reservoir 6 and into the chamber 56 of the bearing pack 32 as lubricant previously in the chamber 56 depletes. The lubricant moves out of the reservoir 6, into the passage 96 of the flex coupling 30, and then into the upper cavity 68 of the flow diverter 28.

This moved lubricant and the pumped motive fluid within the coiled tubing downhole motor are cross-channeled through the flow diverter 28 of the illustrated embodiment. The moved lubricant is conducted from the reservoir via the flex coupling 30 and then through the upper cavity 68, the bore 92 and the aperture 74, and into the outer lubricant chamber 56 of the bearing pack 32; thus, lubricant is automatically maintained in the bearing pack until the reservoir supply is depleted, which enables the motor to be used considerably longer than would be typical in the type of prior downhole motor that does not have a replenishment reservoir as described in the background above. The pumped motive fluid is conducted from outside the rotor 36, through the plurality of apertures 72 and bores 94 of the illustrated embodiment and the cavity 70 of the diverter 28, to the inner passageway 42 extending through the bearing pack 32 (and from there on out through the drill bit or other outlet).

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A downhole lubrication system, comprising:

a lubricant ejector having a reservoir defined therein to hold replenishment lubricant and including a driver to move at least a portion of such replenishment lubricant out of the reservoir in response to a pressure from a flowing fluid, wherein the lubricant ejector is defined to be moved downhole with apparatus requiring lubrication and having a lubrication chamber; and a flow coupler connected to the lubricant ejector such that the flow coupler channels to the lubrication chamber replenishment lubricant moved out of the reservoir in response to operation of the driver;

wherein the lubricant ejector includes:

a rotor of a downhole motor, the rotor having the reservoir defined therein;

a piston disposed in the reservoir; and a plug connected to the rotor, the plug having an orifice defined therethrough such that the pressure communicates through the orifice to act on the piston implementing the driver.

2. A downhole lubrication system as defined in claim 1, wherein the flow coupler is connected to the rotor and is configured to connect to a bearing pack for the downhole motor, wherein the apparatus includes the bearing pack and the bearing pack has the lubrication chamber defined therein.

3. A downhole lubrication system as defined in claim 2, wherein the flow coupler includes a flex coupling connected to the rotor and a flow diverter connected to the flex coupling and configured to connect to the bearing pack.

4. A downhole lubricant applicator, comprising lubricant and a rotor for a downhole motor, the rotor having a longitudinal bore holding the lubricant, the longitudinal bore having a first end through which to receive a force to move at least a portion of the lubricant out a second end of the longitudinal bore.

5. A downhole lubricant applicator as defined in claim 4, further comprising a flow coupler connected to the rotor and having a channel defined therein with a first port thereof communicating with the second end of the longitudinal bore and with a second port thereof for communicating with an outer lubrication chamber of a bearing pack of the downhole motor.

6. A downhole lubricant applicator as defined in claim 5, wherein the flow coupler includes:

a flex coupling having a passage defined therethrough, the flex coupling connected to the rotor such that the passage communicates with the longitudinal bore at the second end thereof; and a flow diverter having a longitudinal cavity and a deviated port defined therein such that the deviated port communicates between the longitudinal cavity and an exterior surface of the flow diverter, the flow diverter connected to the flex coupling such that the longitudinal cavity communicates with the passage of the flex coupling.

7. An extended-lubrication downhole motor, comprising:

a stator configured to connect in a tubing string;

a rotor disposed in the stator such that the rotor rotates in response to fluid pumped through the stator from the tubing string, the rotor having an axial bore;

lubricant disposed in the axial bore;

a piston disposed in the axial bore above the lubricant;

a plug having an orifice defined therein, the plug connected to the rotor such that pressure from the pumped fluid communicates through the orifice and acts against the piston;

a bearing pack; and a flow coupler connected to the rotor and the bearing pack such that the flow coupler communicates to the bearing pack lubricant pushed out of the rotor in response to movement of the piston toward the lubricant in the rotor in response to pressure from the pumped fluid communicated through the orifice.

8. An extended-lubrication downhole motor as defined in claim 7, wherein:

the bearing pack has a longitudinal flow passageway to conduct motive fluid that has flowed along the exterior of the rotor, and the bearing pack has a lubricant chamber disposed radially outwardly from the longitudinal flow passageway; and the flow coupler includes a flow diverter having a body connected to the rotor and the bearing pack, the flow coupler also having a seal disposed on the body, the body having a first channel communicating with the axial bore of the rotor above the seal and with the lubricant chamber of the bearing pack below the seal, and the body having a second channel communicating with the exterior of the body above the seal and with the longitudinal flow passageway of the bearing pack below the seal.

9. An extended-lubrication downhole motor as defined in claim 8, wherein the flow coupler further includes a flex shaft connected to the rotor and the body of the flow diverter, the flex shaft having a passage defined therethrough to provide a lubricant flow path between the axial bore of the rotor and the first channel in the body.

10. A flow diverter for a downhole lubrication system, comprising an inner body having an upper end for connecting to a rotor of a downhole motor and having a lower end for connecting to a bearing pack of the downhole motor, the inner body having defined therein: an upper cavity extending into the inner body from the upper end; a lower cavity extending into the inner body from the lower end; an upper aperture communicating with the lower cavity; and a lower aperture communicating with the upper cavity; and the inner body further including a seal bearing surface disposed between the upper and lower apertures.

11. A flow diverter as defined in claim 10, further comprising a housing having the inner body disposed therein and a seal disposed between the seal bearing surface and an inner surface of the housing.

12. A flow diverter as defined in claim 11, wherein the upper aperture and the lower cavity are configured to conduct a flow of drilling fluid pumped through a tubing string, and the upper cavity and the lower aperture are configured to conduct a flow of replenishment lubricant from the rotor to the bearing pack, when the flow diverter is connected into the tubing string with the downhole motor.

13. A flow diverter for a downhole motor having a bearing pack, comprising a body including:

an upper cylindrical portion from which a threaded coupling extends, the upper cylindrical portion including an upper cavity defined therein such that the upper cavity receives a lubricant for the bearing pack when used in the downhole motor;

a lower cylindrical portion having a partially threaded inner surface connected to the bearing pack when used in the downhole motor, which inner surface defines a lower cavity in the body;

a middle cylindrical portion extending between the upper and lower cylindrical portions, the middle cylindrical portion including an outer cylindrical surface disposed radially outwardly from outer cylindrical surfaces of the upper and lower cylindrical portions;

a first channel defined in the body, the first channel extending between the upper cavity and the exterior of the middle cylindrical portion such that the first channel conducts lubricant from the upper cavity into the bearing pack when used in the downhole motor; and a second channel defined in the body, the second channel extending between the outer cylindrical surface of the upper cylindrical portion and the lower cavity such that the second channel conducts fluid flowing through the downhole motor into the lower cavity when used.

14. A method of replenishing lubricant in a downhole motor, comprising:

operating a downhole motor disposed in a subterranean environment, including pumping fluid into the downhole motor;

moving lubricant from a reservoir in a rotor of the downhole motor, including communicating a pressure responsive to the pumped fluid against a piston disposed in the reservoir with the lubricant; and cross-channeling moved lubricant and pumped fluid within the downhole motor, including conducting moved lubricant from the reservoir to a bearing pack of the downhole motor and conducting pumped fluid from outside the rotor to a passageway through the bearing pack.

* * * * *